US005115658A

United States Patent [19]

Kirchhoff et al.

[11] Patent Number: 5,115,658

[45] Date of Patent: May 26, 1992

[54] SHAPING MACHINE FOR CYLINDRICALLY BENDING A PLATE

[75] Inventors: Wilhelm Kirchhoff, Bochum, Fed. Rep. of Germany; Simon Schneider, Reinach; Hans Zeugin, Dornach, both of Switzerland

[73] Assignees: Chr. Haeusler AG, Duggingen, Switzerland; Bergrohr GmbH, Herne, Fed. Rep. of Germany

[21] Appl. No.: 683,417

[22] Filed: Apr. 10, 1991

[30] Foreign Application Priority Data

Apr. 12, 1990 [CH] Switzerland ..... 1272/90

[51] Int. Cl.[5] ..... B21D 5/14

[52] U.S. Cl. ..... 72/175; 72/173; 72/169; 72/249; 72/420

[58] Field of Search ..... 72/173–175, 72/171, 169, 170, 249, 420

[56] References Cited

U.S. PATENT DOCUMENTS

| | | | |
|---|---|---|---|
| 518,765 | 4/1894 | Plecker | 72/175 |
| 1,767,835 | 6/1930 | Dallas | 72/175 |
| 2,612,934 | 10/1952 | Dubosclard | 72/174 |
| 3,091,279 | 5/1963 | O'Neill | 72/171 |
| 3,564,889 | 2/1971 | Herburg | 72/175 |
| 4,132,099 | 1/1979 | Elsener | 72/175 |
| 4,285,222 | 8/1981 | Jagelid | 72/181 |
| 4,367,640 | 1/1983 | Heitzman | 72/173 |
| 4,491,004 | 1/1985 | Ivanoff | 72/171 |
| 4,614,099 | 9/1986 | Coulter | 72/249 |

FOREIGN PATENT DOCUMENTS

| | | | |
|---|---|---|---|
| 274318 | 11/1990 | Japan | 72/175 |
| 49861 | 8/1921 | Sweden | 72/174 |

*Primary Examiner*—Daniel C. Crane

*Attorney, Agent, or Firm*—Spencer, Frank & Schneider

[57] ABSTRACT

A shaping machine for bending a plate into a cylindrical shape which comprises a frame and first, second, and third roll assemblies disposed on the frame. Each of the roll assemblies includes a roll for engaging a plate to be bent and a plurality of pairs of support rollers axially distributed along and supporting the roll. There is a drive disposed at the frame for rotatably driving each of the rolls of the first, second, and third roll assemblies, and at least one of the roll assemblies is displaceable transversely to the longitudinal axis of its roll.

10 Claims, 4 Drawing Sheets

SHAPING MACHINE FOR CYLINDRICALLY BENDING A PLATE

BACKGROUND OF THE INVENTION

The present invention relates to a shaping device for forming a metal workpiece into a cylindrical shape.

Such shaping devices are generally known for producing a pipe from a cylindrically shaped body. A great difficulty lies in shaping thick-walled sheet metal plates, that is, plates having a thickness of, for example, 35 mm, into a very long cylindrical body having a precise circular cross section. There is another difficulty in that, for long pipes, measures must be taken which prevent the forming rolls, particularly the top roll, from bending. This difficulty cannot be overcome by selecting a top roll that has the largest possible diameter because the diameter of the top roll must be smaller than the inner diameter of the cylindrical shape to be produced. Several machines are known for this purpose, all for specific applications:

There is a known three-roll machine whose rolls are displaceably mounted at both ends in a frame. Since, during the deformation of the workpiece, the rolls bend through and this bending is a function of the length and thickness of the roll as well as of the thickness of the workpiece, the use of such a machine is limited to the production of relatively short hollow cylinders. A significant improvement of such machines can be realized by extending the rolls considerably beyond their supports and by exerting a counter-force on the ends of the rolls.

Also known is the use of a folding press with which it is possible to produce long cylindrical shapes. Its drawback is not only that the workpieces worked by a folding press do not have a round but rather a polygonal shape, which has drawbacks under heavy stresses on the pipe, but also that the process operates rather slowly.

Additionally, a pipe press is known which includes a plurality of C-shaped frames to which pressing tools are attached. Although it is possible to produce cylindrical bodies with such machines, that is, polygons having rounded edges, of generally any desired length, a different set of press molds is required for each desired cylinder diameter and for each thickness of sheet metal to be processed, so that the machine is expensive and working with it is time consuming due to the relatively long changeover times involved.

Also known is a press including two die plates which together define a cylindrical cavity. With such a press, a plate can be shaped into a cylindrical hollow body. The drawbacks of this machine are that the production of the press mold is very expensive and is subjected to a considerable amount of wear, tool changes are labor intensive, and the deformation of the workpiece occurs in a considerably forced manner which adversely affects its structure and which results in hardened portions in the region of the seam edges.

There is a known press including two bottom rolls and upper pressing tools. This press is an expensive structure which operates only relatively slowly and, moreover, has a high power consumption, with additional tools being needed to bend the seam ends.

For the production of relatively thin-walled but very long pipes having a small to average diameter, that is, up to about 50 cm, profiling lines are known which include a plurality of paired rollers. These known machines also require special tools for each pipe dimension; tools that are quite expensive and their exchange is time consuming to a great extent.

Other prior art devices exist with which a band-shaped workpiece is wound in the manner of a helix to produce a tubular body. These machines are also not suitable for processing thick-walled workpieces and involve substantial time for changes to accommodate other pipe dimensions.

SUMMARY OF THE INVENTION

It is thus an object of the present invention to provide an improved shaping machine which is suitable for the relatively quick but highly precise deformation of thick workpieces into correspondingly thick-walled cylindrical hollow bodies from small to large diameters and also of long lengths and which does not need a different tool for each dimension of the starting material and of the end product. The term "relatively quick" is here understood to mean a period of time of less than five minutes for the production of a hollow cylindrical body having a length of 10 to 15 m and a wall thickness up to 35 mm.

This object and others to become apparent as the specification progresses, are accomplished by the invention according to which, briefly stated, the shaping machine has a frame and first, second, and third roll assemblies disposed on the frame. Each of the roll assemblies includes a roll for engaging a plate to be bent. Each roll has a longitudinal axis and a plurality of pairs of support rollers is axially distributed along and supports the roll. There is a drive disposed at the frame for rotatably driving each of the rolls of the first, second, and third roll assemblies and a means attached to the frame for displacing at least one of the roll assemblies transversely to the longitudinal axis of its roll.

It is advantageous that all rolls be provided with electric or hydraulic motors at both ends, and one of the two motors which drive the top roll is arranged to be decoupled and pivoted away from the end of the roll. The rolls themselves may be connected with the corresponding ends of uniformly distributed C-shaped frames in any desired manner. It is possible, for example, to provide the top roll at each frame with a groove and to provide each groove with a belt whose ends are suspended from the C-frame to thus suspend the roll. The bottom rolls may rest on the support rollers and may possibly be secured by additional guide means.

DESCRIPTION OF THE PREFERRED EMBODIMENT

Figure 1:
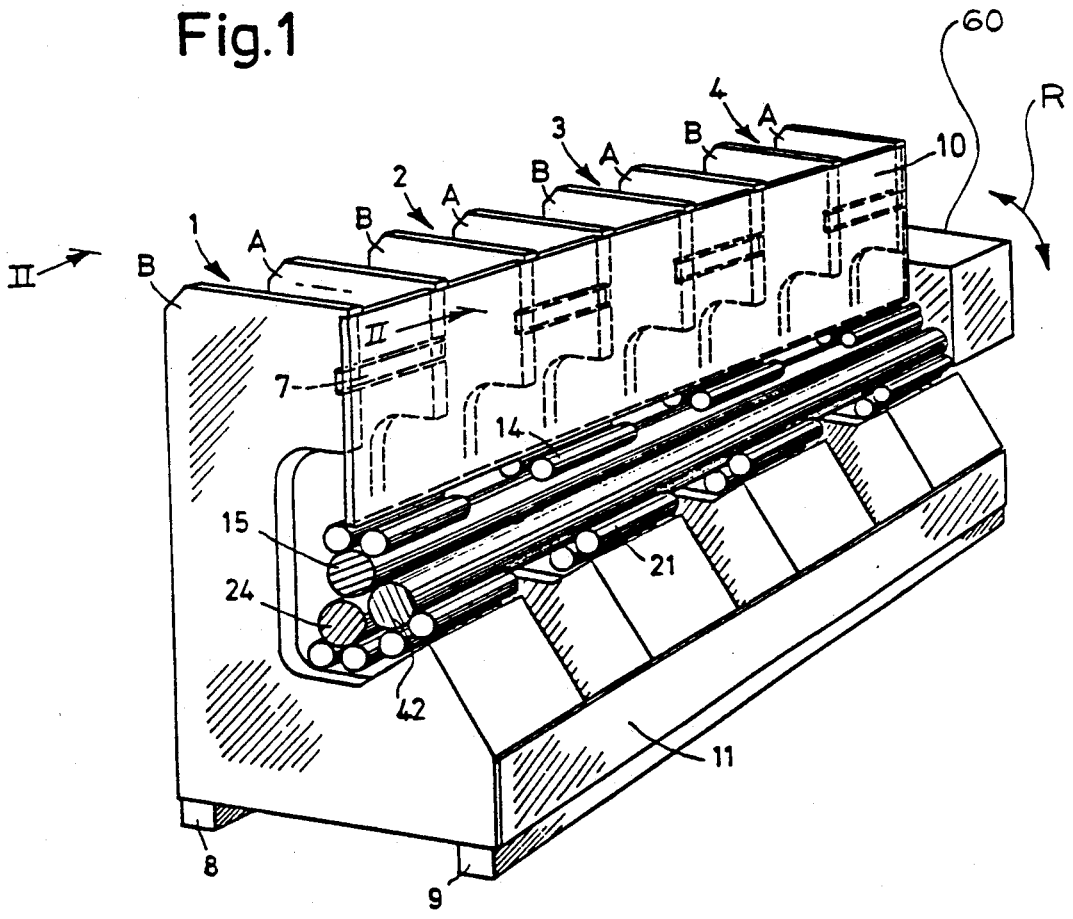
FIG. 1 is a schematic perspective view of a preferred embodiment of a shaping machine according to the invention in which the drive members disposed at the closer roll ends have been omitted.

The shaping machine shown in FIG. 1 includes a frame assembly formed of four C-shaped frames 1, 2, 3 and 4 each formed of two vertical plates A and B. All frames 1 to 4 are standing on supports 8 and 9, or on a base, and are connected with one another by means of a face plate 10 and a frame member 11. In order to increase rigidity, plates A and B of a frame 1 to 4 and the juxtaposed frames may be interconnected by means of further connecting elements.

Figure 2:
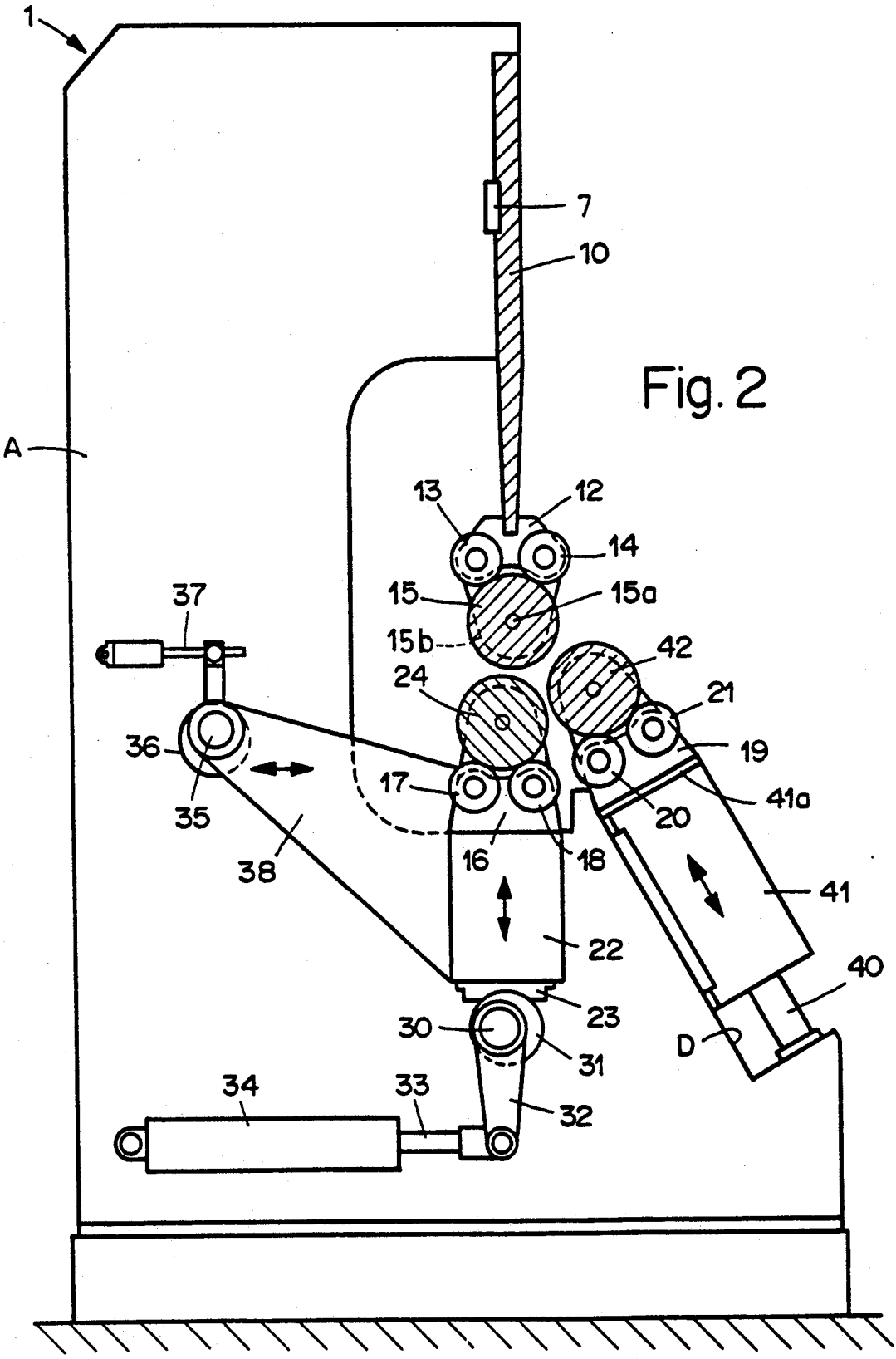
FIG. 2 is a sectional view taken along line II—II of FIG. 1.

As can be seen in FIG. 2, a stub shaft 30 is mounted in two plates A and B of each C-frame 1 to 4 and is provided with an eccentric disc 31 and a lever arm 32. A free end of lever arm 32 is hinged to a piston rod 33 of a hydraulic cylinder 34 so that displacement of piston rod 33 in the cylinder pivots lever 32 and eccentric disc 31. Such a pivotal motion shifts a contact plate 23 upwardly or downwardly and also slightly laterally. A block 22 is mounted on plate 23 so as to be horizontally displaceable by means of an eccentric 36 seated on a shaft 35. A schematically shown rotating or displacing device 37 is coupled to the shaft 35 which is mounted in both plates A and B. A connecting plate 38 is provided with a bore for eccentric 36. A carrier 16 for two support rollers 17 and 18 for a bottom roll 24 which extends over the entire length of the shaping machine is disposed on block 22. Non-illustrated securing means prevents roll 24 from moving away from its location on support rollers 17 and 18.

At the lower end of C-shaped frame 1 to 4 there is supported a piston 40 of a hydraulic cylinder 41 which, depending on the supply of hydraulic fluid, moves up and down on an oblique slide face D. A carrier 19 for two support rollers 20 and 21 is seated on a closed end 41*a* of cylinder 41. The two support rollers 20 and 21, in turn, support a second bottom roll 42, which is the bending roll proper. Bottom roll 42 too, is secured in place on the support rollers 20, 21 of all C-frames 1 to 4 by auxiliary means (not shown). Such auxiliary means for roll 42 as well as for roll 24 may be guide shoes or metal bands which are guided in a groove in the roll and have both their ends fastened to carriers 19 and 16.

At the bottom of face plate 10 in the plane of each C-shaped frame 1 to 4, a carrier 12 is attached in which two support rollers 13 and 14 are able to rotate freely. These support rollers 13 and 14 serve to support a top roll 15 suspended from carrier 12 or face plate 10 by means of belts guided in the grooves 15*b* of top roll 15. Roll 15 has a longitudinal axis 15*a*, and a first roll assembly includes carrier 12, roll 15, and support rollers 13 and 14. A second roll assembly includes carrier 16, roll 24, and support rollers 17 and 18; and a third roll assembly includes carrier 19, roll 42, and support rollers 20 and 21.

All three rolls, that is, top roll 15 and bottom rolls 24 and 42, are each provided at both ends with a drive 60, of which only the right hand drive 60 is shown. Each of the two drives 60 may include a hydraulic or electric motor. One of the two drives 60 serving to drive top roll 15 is releasable from the roll and is pivotal away from the roll 15 in a direction as indicated by double-headed arrow R. Such releasing and pivoting of a drive away from a roll is known from conventional three or four roll machines in which a workpiece shaped into a hollow cylinder can be axially removed.

Turning to FIGS. 3 to 6, the process of working with the shaping machine according to the invention will now be explained.

Figure 3:
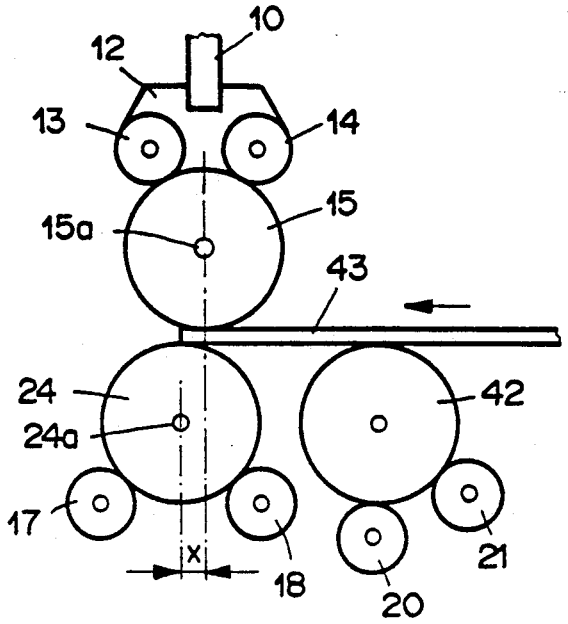
FIGS. 3 to 6 are schematic side elevational views of the preferred embodiment of the invention illustrating sequential operational steps in the production of a cylindrical hollow body.

FIG. 3 shows that when a workpiece, such as a sheet metal plate 43, is introduced between top roll 15 and bottom roll 24, the two lower rolls, that is, the bottom roll 24 proper and bending roll 42, are disposed at the same height so that workpiece 43 can be easily introduced horizontally. Longitudinal axis 24*a* of bottom roll 24 is offset to the left by a distance X relative to axis 15*a* of top roll 15, the offset also being shown in FIG. 2. Thereafter the bending roll 42 is raised by inflowing hydraulic fluid pushing cylinder 41 upwardly on slide face D until it assumes the position shown in FIG. 4.

As the next step, the entire three-roll bending machine is put into operation, that is, each one of rolls 15, 24 and 42 operatively engages workpiece 43 and is rotated by drive 60. As a result, the workpiece 43 is bent in the manner shown in FIG. 4. When edge 43*a* of workpiece 43 abuts against face plate 10, the rolling process is halted and lower rolls 24 and 42 are moved downwardly until workpiece 43 can be pulled axially out of the shaping machine. For this purpose, one of the two drive motors of drive 60 is pivoted away from top roll 15 as is known in connection with three-or four-roll machines. Then bending roll 42 is again moved downwardly until it is disposed at the same height as bottom roll 24.

Figure 5:
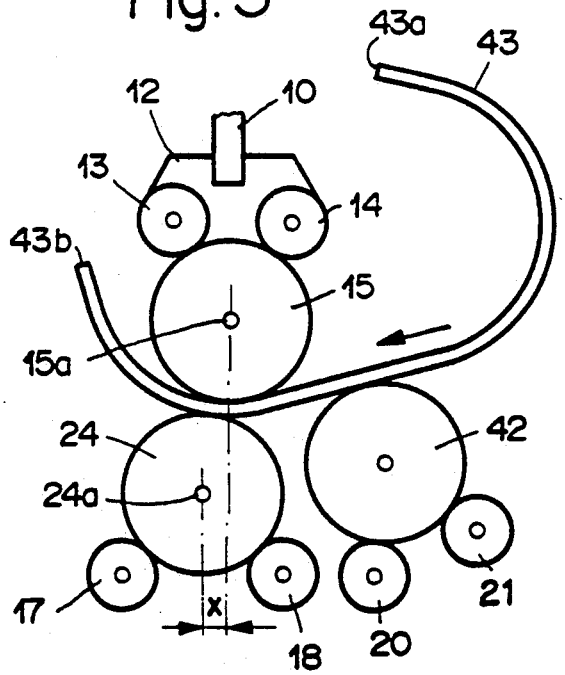
Figure 6:
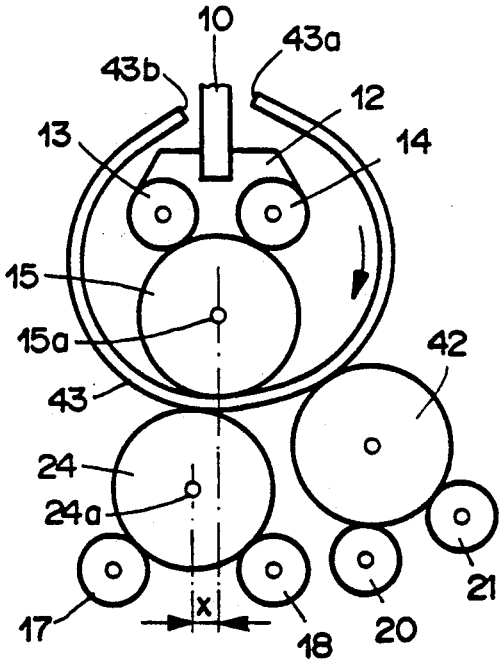

Thereafter the workpiece 43 is introduced into the shaping machine with its other transverse edge 43*b* first, the bending roll 42 is raised again, and the rolling process resumes as shown in FIG. 5. As soon as the state shown in FIG. 6 is reached, that is, both workpiece edges 43*a* and 43*b* contact face plate 10, the rolling process is terminated and workpiece 43 is removed from the machine in the manner described above.

In order to make a pipe from the thus-shaped hollow cylinder, the two edges 43*a* and 43*b* must be welded together, which can be accomplished by means of known tacking machines and known welding methods.

A significant advantage to be realized with the shaping machine according to the invention is that sheet metal pieces of any desired thickness and very long lengths can be given a hollow cylindrical shape since the C-shaped frames 1 to 4, which may be provided in any desired number and of which each is provided with a pair of support rollers for each shaft, absorb the flexural forces and thus avoid a disadvantageous bending of the rolls which may occur in conventional three-or four-roll bending machines and which could not be satisfactorily controlled. The distance between adjacent C-frames 1 to 4 depends on the magnitude of the load for which the shaping machine is designed. For example, a distance of 80 to 150 cm, that is, approximately 120 cm, from center to center of the frame may be advisable. Additionally, the shaping machine according to the invention may also produce pipes having a very small diameter since only the top roll 15 and its support rollers 13, 14, together with the carrier 12 need be accommodated within the pipe and the gap remaining between the two workpiece ends corresponds only to the thickness of face plate 10. It is to be understood that the most varied sizes of workpieces can be processed without needing other bending rollers. It is merely necessary to slightly raise or lower bottom roll 24 depending on the thickness of the workpiece and the desired diameter of the hollow body. Such displacements are accomplished by the mechanism composed of members 22 and 23 as well as 30 to 34; additionally the horizontal distance X must be set which can be effected by means of the device as described in connection with FIG. 2 and composed of members 35 to 38.

For the production of pipes having an extremely small diameter it may be necessary, however, to exchange the customarily employed top roll 15 for a top roll having a smaller diameter and to exchange the entire face plate 10 together with the carrier 12 as well as support rollers 13 and 14. This can be effected particularly easily if auxiliary means, for example webs 7 shown in FIG. 1, are provided to transmit the forces from face plate 10 to plates A and B of each C-frame, and face plate 10 itself is secured by simple fastening means which do not transmit forces, for example a few screws which prevent inadvertent release from C-frames 1 to 4.

Due to the fact that workpiece 43 is rolled round in a uniform processing phase, workpiece 43 is treated very gently, which is of importance particularly for steels of a high degree of purity, given that preliminary or subsequent working of the edges by rolling results in additional hardening and thus in a reduction in quality.

It is feasible to provide an automatic regulator for this device, including an element for measuring the curvature of the workpiece and a computer controlled by this element. The computer, in turn, controls the shifting of the bottom roll 24 and the bending roll 42.

When working with a single shaping machine as described above, after the first process phase, that is when workpiece 43 has been half processed and is removed from the machine, the workpiece must be turned around which requires auxiliary manipulating means and a large amount of space, and is furthermore very time-consuming.

Figure 7:
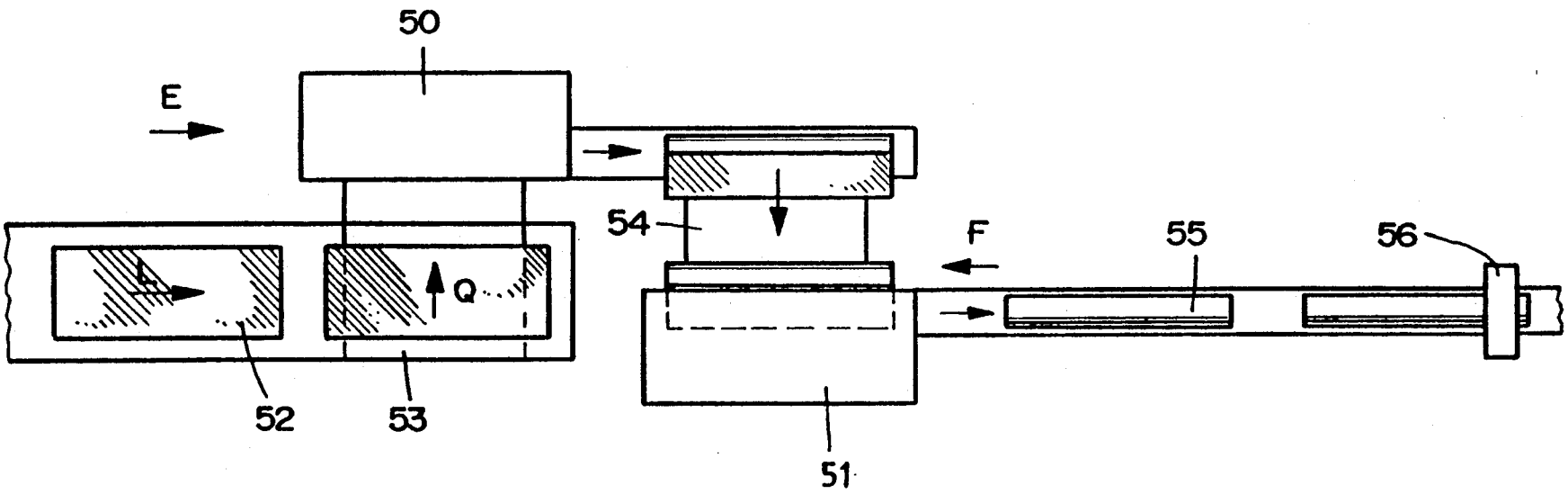
FIG. 7 is a basic layout of a shaping system according to the invention including two shaping machines of the preferred embodiment of FIG. 1.

This requirement of maneuvering the half finished workpiece can be eliminated by providing, as shown in FIG. 7, two such shaping machines 50 and 51 in a shaping system, together with a tacking device 56, to constitute a pipe producing system. Shaping machine 50 receives rectangularly cut sheet metal plates 52 by means of a conveying device 53 which first advances the plates in the longitudinal direction L of the system and then moves them in the direction Q perpendicular thereto.

Figure 4:
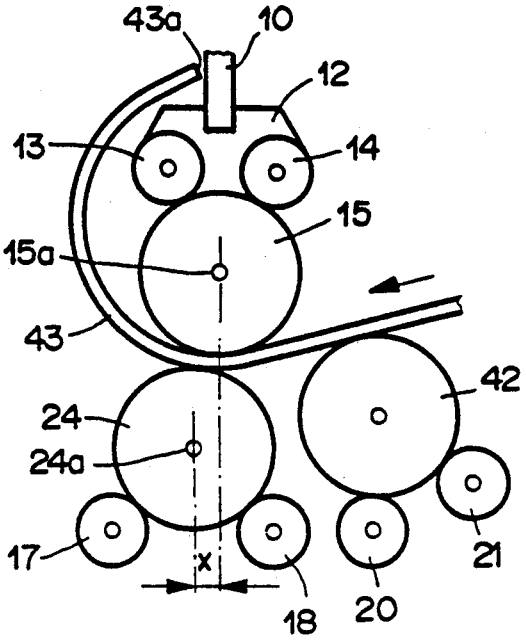

In shaping machine 50, plate 52 is deformed as described with reference to FIGS. 3 and 4. Then the half-worked workpiece 52 is moved out of shaping machine 50 by a known auxiliary means toward the right in the manner described above. Thereafter, workpiece 52 is transported by means of a transverse conveyor 54 to the second shaping machine 51. While the first shaping machine 50 is oriented so that the opening of the C-frames faces the conveying device 53, the shaping machine 51 is disposed substantially as a mirror image to the shaping machine 50 so that the opening of its C-frames is oriented toward the transverse conveyor 54. In this two-machine system, the space required for rotation of workpiece 52 is unnecessary and the workpiece may be introduced into shaping machine 51 in the same orientation as it had when leaving shaping machine 50.

The second part of the shaping process then takes place in shaping machine 51 in the manner described in connection with FIGS. 5 and 6. The FIGS. 3 and 4 show the shaping machine 50 as viewed in the direction of arrow E, while FIGS. 5 and 6 show shaping machine 51 as seen in the direction of arrow F.

After finish-rolling of the workpiece, the latter is moved into an intermediate location 55 and from there to the tacking device 56 which is a known machine that compresses the gap between the two mutually adjacent longitudinal edges of the workpiece and provides it with a tacked seam, followed by further shaping in the tacking device, if necessary.

Since the shaping of a piece of sheet metal in each one of the two shaping machines takes only about 2 to 3 minutes, the entire shaping system is able to operate in a two- to three-minute cycle; that is, the system having two shaping machines produces one cylindrical pipe every 2 to 3 minutes.

It will be understood that the above description of the present invention is susceptible to various modifications, changes, and adaptations, and the same are intended to be comprehended within the meaning and range of equivalents of the appended claims.

What is claimed is:

1. A shaping machine for bending a plate into a cylindrical shape, comprising:

(a) a frame assembly including
  (1) a plurality of C-shaped frames aligned in a series along a length of the machine and
  (2) securing means for fastening the frames to one another;

(b) first, second and third rolls for engaging the plate to be bent; each said first, second and third roll extending through said C-shaped frames along the length of the machine; each said first, second and third roll having a longitudinal axis;

(c) a plurality of first pairs of support rollers axially distributed along and supporting said first roll; each said C-shaped frame supporting a separate said first pair of support rollers;

(d) a plurality of second pairs of support rollers axially distributed along and supporting said second roll; each said C-shaped frame supporting a separate said second pair of support rollers;

(e) a plurality of third pairs of support rollers axially distributed along and supporting said third roll; each said C-shaped frame supporting a separate said third pair of support rollers;

(f) drive means disposed at said frame assembly for directly rotating each said first, second and third roll; and (g) displacing means mounted on said frame assembly for displacing at least one of said plurality of first, second and third pairs of support rollers together with a respective said first, second and third roll transversely to the longitudinal axis thereof.

2. A shaping machine as defined in claim 1, wherein each said C-shaped frame includes two aligned, upright, C-shaped plates spaced from one another along said length of the machine.

3. A shaping machine as defined in claim 1, wherein said C-shaped frames are spaced from one another.

4. A shaping machine as defined in claim 1, wherein said displacing means comprises a plurality of power mechanisms mounted in each said C-shaped frame and operatively connected to respective pairs of support rollers in each said C-shaped frame.

5. A shaping machine as defined in claim 1, wherein the first roll is a top roll; the second and third rolls are bottom rolls disposed below said top roll.

6. A shaping machine as defined in claim 5, further comprising means for decoupling and moving away said drive means from said top roll.

7. A shaping machine as defined in claim 1, wherein the first, second, and third rolls comprise two opposed ends; said drive means comprises a drive disposed at each said end.

8. A shaping machine as defined in claim 7, wherein at least one of said drives comprises a hydraulic motor.

9. A shaping machine as defined in claim 7, wherein at least one of said drives comprises an electric motor.

10. A system for bending a plate into a cylindrical shape, comprising:

a first shaping machine for partially bending the plate;

a second shaping machine for completing bending the plate into the cylindrical shape;

each said shaping machine including:

a frame;

first, second, and third roll assemblies disposed on said frame; each said roll assembly including:

a roll for engaging a plate to be bent; said roll having a longitudinal axis; and a plurality of pairs of support rollers axially distributed along and supporting said roll;

drive means disposed at said frame for rotatably driving each said roll of the first, second, and third roll assemblies;

means attached to said frame for displacing at least one of said roll assemblies transversely to the longitudinal axis of the roll of said one roll assembly;

a feeder device for supplying a plate to be partially bent to said first shaping machine;

conveying means for transporting a partially bent plate to said second shaping machine; and means for moving a completely bent cylindrical plate away from said second shaping machine.

* * * * *